US005890782A

United States Patent [19]

Alberts

[11] Patent Number: 5,890,782

[45] Date of Patent: Apr. 6, 1999

[54] STUDENT DESK CARREL CONSTRUCTION SYSTEM

[76] Inventor: Virginia Ann Alberts, 5967 Lewis, Dallas, Tex. 75206

[21] Appl. No.: 937,171

[22] Filed: Sep. 25, 1997

Related U.S. Application Data

[60] Provisional application No. 60/027,587, Oct. 3, 1996.

[51] Int. Cl.[6] ..... A47B 27/00

[52] U.S. Cl. ..... 312/196; 16/225; 16/390; 248/231.81; 312/258; 108/27

[58] Field of Search ..... 312/258, 197, 312/196; 108/27; 248/231.81, 459; 24/457; 16/225, 390, 252

[56] References Cited

U.S. PATENT DOCUMENTS

| | | | |
|---|---|---|---|
| 2,240,729 | 5/1941 | Von Palmenberg | 16/225 X |
| 2,942,924 | 6/1960 | Stangert | 108/27 |
| 3,326,147 | 6/1967 | Toney | 108/27 |
| 3,629,960 | 12/1971 | Roush | 108/27 X |
| 3,889,736 | 6/1975 | Firks | 16/225 X |
| 4,670,938 | 6/1987 | Fowlston | 16/225 |
| 4,828,132 | 5/1989 | Francis, Jr. et al. | 16/225 X |
| 5,487,690 | 1/1996 | Stoffle et al. | 16/225 X |
| 5,490,658 | 2/1996 | Coward et al. | 248/683 |
| 5,539,955 | 7/1996 | Wiese | 16/225 |
| 5,729,867 | 3/1998 | Carmichael | 16/225 |

*Primary Examiner*—Jose V. Chen
*Assistant Examiner*—Stephen Vu
*Attorney, Agent, or Firm*—Joseph N. Breaux

[57] ABSTRACT

A student carrel construction system including a pair of hinge members each being flexible along the longitudinal axis thereof and having a first and second board receiving slot on either side of the longitudinal axis thereof, each of the board receiving slots being defined by a pair of sidewalls that are coated with an adhesive and covered with a peel off cover member; and at least three desk clips, each of the desk clips including a first surface, coated with an adhesive and covered by a peel off cover member, a desk top contact ledge extending perpendicularly from one end of the first surface, a curved portion curving under and past the one end of the first surface, and a desk bottom contact ledge extending in a direction substantially parallel to the desk top contact ledge.

16 Claims, 2 Drawing Sheets

STUDENT DESK CARREL CONSTRUCTION SYSTEM

This application claims the benefits under 35 U.S.C. 119(e) of earlier filed provisional application No. 60/027587, filed Oct. 03, 1996.

TECHNICAL FIELD

The present invention relates to privacy screens and more particularly to a student carrel construction system including a pair of flexible, hinges having pre-applied adhesive and at least three desk clips having a pre-applied adhesive and a desk top contact ledge portion. The hinges and desk clips can be attached to three sections of sheeting, such as cardboard or plastic laminate, to construct an inexpensive desk top carrel for students and the like.

BACKGROUND OF INVENTION

With increasing student enrollment in schools, class sizes are increasing to unmanageable levels. In addition, increased demand on limited financial resources prevents schools from buying new equipment, such as desks, to better handle the increased class sizes. It would be desirable, therefore, to have an inexpensive student carrel construction system that could be purchased by school systems or even teachers to build inexpensive student carrels for students to use at their desks to allow for isolated study and work areas. Because of extremely limited budgets, it would be a further benefit, if the construction system allowed the use of inexpensive materials such as discarded cardboard as the main screening material for the carrel.

Because children often bump into or knock against the carrel, it would be a further benefit to have a student carrel construction system that included a number of desk top clips for clipping the student carrel to the top of a student's desk that included a desk top contact ledge to prevent the carrel from falling from a student desk top when minor bumps and knocks are received by the student carrel.

SUMMARY OF INVENTION

It is thus an object of the invention to provide a student carrel construction system that is inexpensive.

It is a further object of the invention to provide a student carrel construction system that converts inexpensive materials such as discarded cardboard into usable student carrels.

It is a still further object of the invention to provide a student carrel construction system that includes a number desk top clips for clipping the student carrel to the top of a student's desk that are provided with a desk top contact ledge to prevent the carrel from falling from a student desk top when minor bumps and knocks are received by the student carrel.

It is a still further object of the invention to provide a student carrel construction system that accomplishes all or some of the above objects in combination.

Accordingly, a student carrel construction system is provided. The student carrel construction system comprises a pair of hinge members each being flexible along the longitudinal axis thereof and having a first and second board receiving slot on either side of the longitudinal axis thereof, each of the board receiving slots being defined by a pair of sidewalls that are coated with an adhesive and covered with a peel off cover member; and at least three desk clips, each of the desk clips including a first surface, coated with an adhesive and covered by a peel off cover member, a desk top contact ledge extending perpendicularly from one end of the first surface, a curved portion curving under and past the one end of the first surface, and a desk bottom contact ledge extending in a direction substantially parallel to the desk top contact ledge. If desired, the student carrel construction system can further include adhesive backed hook and pile fastener strips that can be applied to the underside of the desk top contact and to the desk bottom contact ledges of the desk clip. The fastener strips that are secured to the underside of the desk top are applied at a location selected to allow the strips applied to the desk bottom contact ledges to fasten thereto to provide additional holding strength to prevent the student carrel from being knocked off the desk by inadvertent bumps and knocks.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
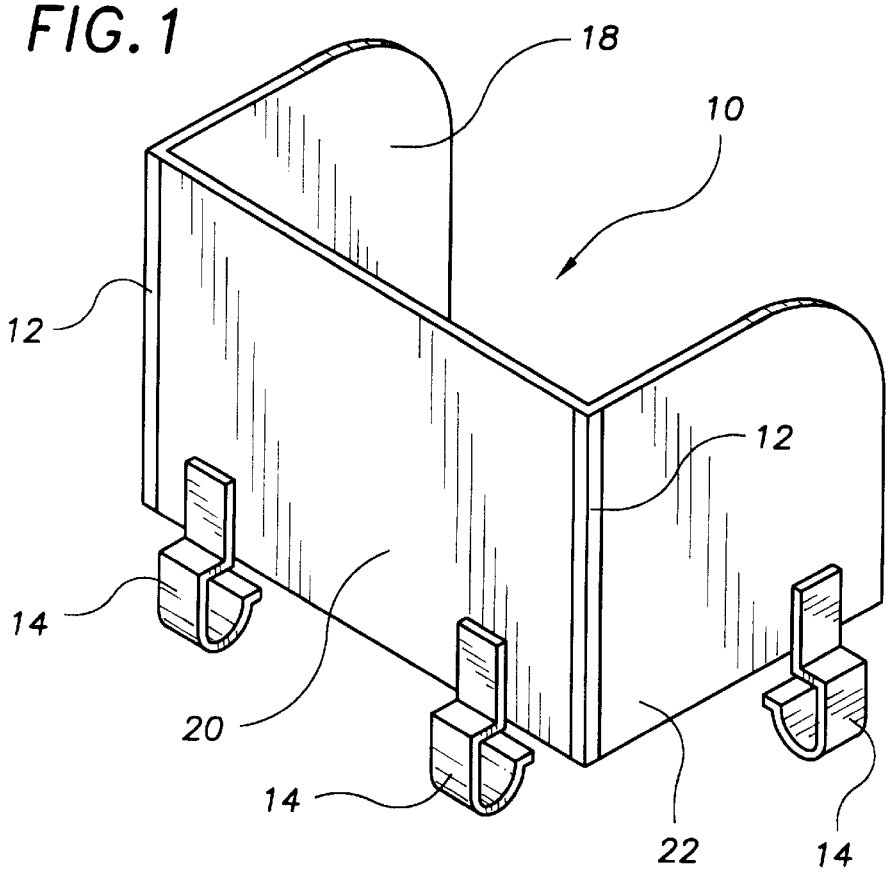
FIG. 1 is a perspective view of an exemplary student carrel constructed using an exemplary embodiment of the student carrel construction system of the present invention.

FIG. 1 shows a representative student carrel, generally designated by the numeral 10, constructed from an exemplary student carrel construction system of the present invention. In this embodiment, the construction system includes four identical desk clips 14 (only three shown) and two identical hinge members 12. The remaining materials used to construct representative carrel 10 are three sections 18,20,22 of cardboard salvaged from a readily available, heavy-weight card board box.

Figure 2:
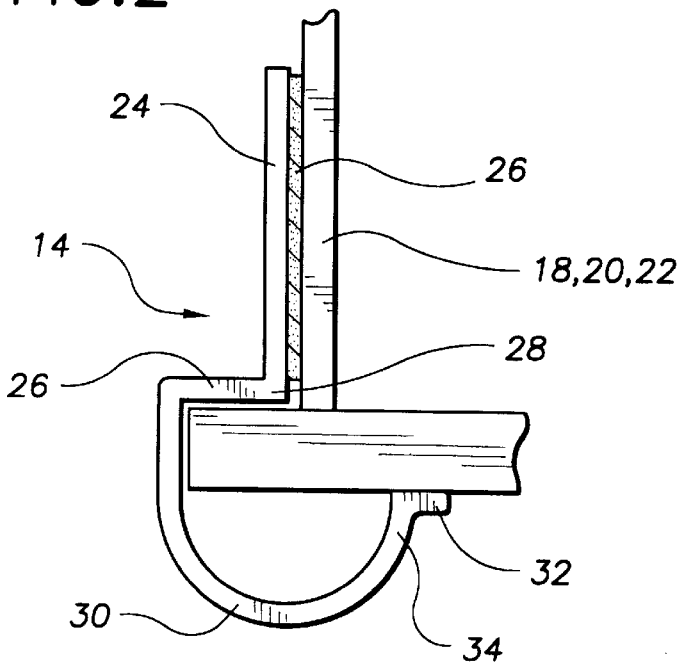
FIG. 2 is a side view of an exemplary desk clip adhesively secured to a fiberboard and shown clipped to a representative desk top.
Figure 3:
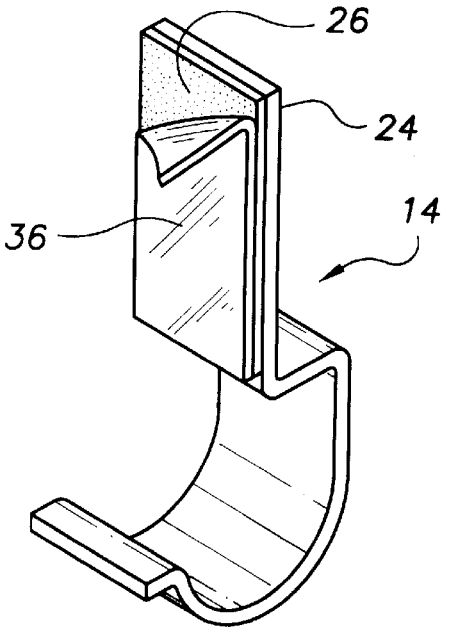
FIG. 3 is a perspective view of one of the four desk clips provided in the exemplary student carrel construction system showing the adhesive surface, the peel off cover member, the desk top ledge, and the arcuately shaped clip member.

With reference to FIG. 2, each desk clip 14 is molded from resilient plastic and includes a first surface 24 that is coated with an adhesive layer 26 suitable for forming an adhesive connection between first surface 24 and a material such as cardboard sections 18,20,22. A desk top contact ledge portion 26 extends perpendicularly from one end 28 of first surface 24 for about one inch. A curved portion 30 extends from ledge portion 26 and curves under and past end 28 of first surface 24. A desk bottom contact ledge 32 extends from the other end 34 of curved portion 30 in a direction substantially parallel to desk top contact ledge 26. In this embodiment, desk bottom contact ledge is about one-half inch wide. With reference to FIG. 3, desk clips 14 are shipped with a peel off cover member 36 covering adhesive layer 26. Peel off cover member 36 is removed prior to positioning adhesive layer 26 against an edge surface of a cardboard section 18,20,22, or other sheet type material, used to construct a student carrel.

Figure 4:
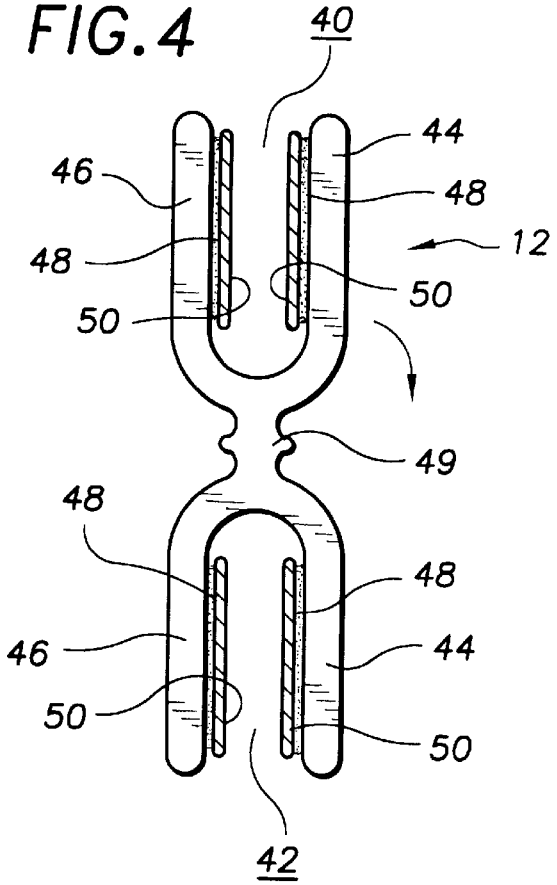
FIG. 4 is a side view of one of the hinge members of the exemplary construction system showing the two board receiving slots, the adhesive layers, and the peel off cover members.
Figure 5:
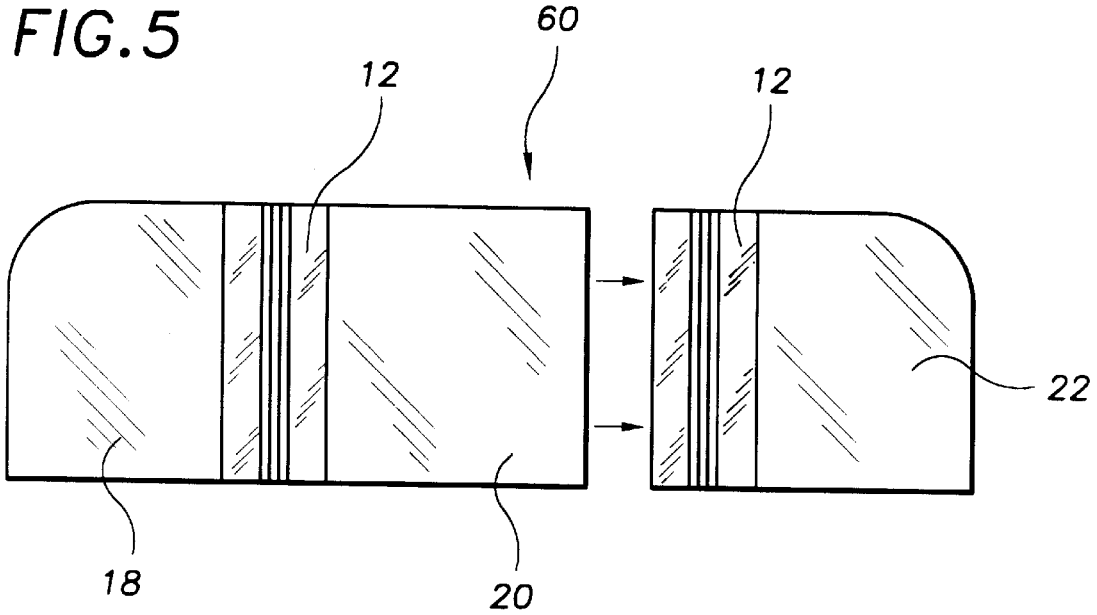
FIG. 5 is a plan view showing connection of the two hinge members. One secured between two sections of non-absorbent laminate board and one prior to insertion of the laminate board edge into the remaining board receiving slot of the remaining hinge member.

With reference to FIG. 4, hinge members 12 are identical and are constructed from resilient plastic. Each hinge member 12 is flexible along a central longitudinal axis 49 to allow sections 18,20,22 to be bent with respect to each other when carrel 10 is fully constructed. Each hinge member 12 has a first and second board receiving slot 40,42 located on either side of the longitudinal axis 49. Slots 40,42 are defined by a pair of sidewalls 44,46 that are coated with an adhesive layer 48 and covered with a peel off cover member 50. In use, the edges of sections 18,20,22 are inserted into and adhesively held within slots 40,42. With reference to FIG. 5, peel off cover members 50 are removed prior to inserting the edges of sections 18,20,22 into slots 40,42 to form the a screening element 60 portion of carrel 10. Use of carrel 10 is as described above.

It can be seen from the preceding description that a student carrel construction system has been provided that is inexpensive, that utilizes inexpensive materials, and that includes a number desk top clips for clipping the student carrel to the top of a student's desk that are provided with a desk top contact ledge to prevent the carrel from falling from a student desk top when minor bumps and knocks are received by the student carrel.

It is noted that the embodiment of the student carrel construction system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A student carrel construction system for use with a desk including a desk top having an underside, said student carrel construction system comprising:

a plurality of board sections, a pair of hinge members each being flexible along a longitudinal axis thereof and having a first and a second board receiving slot on either side of said longitudinal axis thereof, each of said board receiving slots being defined by a pair of sidewalls that are coated with an adhesive for engaging one of said board sections and covered with a peel off cover member; and plurality of desk clips, each of said plurality of desk clips including a first surface, coated with an adhesive for engaging one of said board sections and covered by a peel off cover member, a desk top contact, ledge extending perpendicularly from one end of said first surface, a curved portion extending from said desk top contact ledge and curving under and past said one end of said first surface, and a desk bottom contact ledge extending from said curved portion in a direction substantially parallel to said desk top contact ledge.

2. The student carrel construction system of claim 1, wherein:

said desk clips are molded from resilient plastic.

3. The student carrel construction system of claim 2 wherein:

each of said desk bottom contact ledges is one-half inch wide.

4. The student carrel construction system of claim 3 wherein:

said hinge members are each constructed from resilient plastic.

5. The student carrel construction system of claim 4, further including:

six adhesive backed hook and pile fastener strips, three adapted to be applied to an underside of a desk top and three being appliable to a said desk bottom contact ledge of a said desk clip.

6. The student carrel construction system of claim 3, further including:

six adhesive backed hook and pile fastener strips, three adapted to be applied to an underside of a desk top and three being appliable to a said desk bottom contact ledge of a said desk clip.

7. The student carrel construction system of claim 2 wherein:

said hinge members are each constructed from resilient plastic.

8. The student carrel construction system of claim 7, further including:

six adhesive backed hook and pile fastener strips, three adapted to be applied to an underside of a desk top and three being appliable to a said desk bottom contact ledge of a said desk clip.

9. The student carrel construction system of claim 8 wherein:

said hinge members are each constructed from resilient plastic.

10. The student carrel construction system of claim 9, further including:

six adhesive backed hook and pile fastener strips, three adapted to be applied to an underside of a desk top and three being appliable to a said desk bottom contact ledge of a said desk clip.

11. The student carrel construction system of claim 2, further including:

six adhesive backed hook and pile fastener strips, three adapted to be applied to an underside of a desk top and three being appliable to a said desk bottom contact ledge of a said desk clip.

12. The student carrel construction system of claim 1 wherein:

each of said desk bottom contact ledges is one-half inch wide.

13. The student carrel construction system of claim 12, further including:

six adhesive backed hook and pile fastener strips, three adapted to be applied to an underside of a desk top and three being appliable to a said desk bottom contact ledge of a said desk clip.

14. The student carrel construction system of claim 1 wherein:

said hinge members are each constructed from resilient plastic.

15. The student carrel construction system of claim 14, further including:

six adhesive backed hook and pile fastener, strips, three adapted to be applied to an underside of a desk top and three being appliable to a said desk bottom contact ledge of a said desk clip.

16. The student carrel construction system of claim 1, further including:

six adhesive backed hook and pile fastener strips, three adapted to be applied to an underside of a desk top and three being appliable to a said desk bottom contact ledge of a said desk clip.

* * * * *